US011072196B2

(12) United States Patent
Li

(10) Patent No.: US 11,072,196 B2
(45) Date of Patent: Jul. 27, 2021

(54) STAMP DEVICE

(71) Applicant: PARRIC NINGBO STATIONERY AND GIFTS MFG. CO., LTD, Ningbo (CN)

(72) Inventor: Fuping Li, Ningbo (CN)

(73) Assignee: PARRIC NINGBO STATIONERY AND GIFTS MFG. CO., LTD., Ningbo (CN)

( * ) Notice: Subject to any disclaimer, the term of this patent is extended or adjusted under 35 U.S.C. 154(b) by 149 days.

(21) Appl. No.: 16/203,269

(22) Filed: Nov. 28, 2018

(65) Prior Publication Data

US 2019/0092062 A1 Mar. 28, 2019

Related U.S. Application Data

(63) Continuation-in-part of application No. PCT/CN2017/095806, filed on Aug. 3, 2017.

(30) Foreign Application Priority Data

Jul. 27, 2017 (CN) ..... 201710627327.5
Jul. 27, 2017 (CN) ..... 201720926083.6

(51) Int. Cl.
*B41K 3/02* (2006.01)
*B41K 3/62* (2006.01)
(Continued)

(52) U.S. Cl.
CPC ..... *B41K 3/02* (2013.01); *B41K 3/32* (2013.01); *B41K 3/62* (2013.01); *B44B 5/0052* (2013.01); *B44B 5/0085* (2013.01)

(58) Field of Classification Search
CPC .... B41K 3/62; B41K 3/32; B41K 3/02; B44B 5/0052; B44B 5/0085
See application file for complete search history.

(56) References Cited

U.S. PATENT DOCUMENTS 2,040,940 A * 5/1936 Johnson ..... B41K 1/58 101/333
2,382,804 A * 8/1945 Morrison ..... B41K 1/02 101/368
(Continued)

FOREIGN PATENT DOCUMENTS

CN 2114579 9/1992
CN 202029528 11/2011
(Continued)

OTHER PUBLICATIONS

The International Search Report (ISR) for PCT/CN2017/095806 dated Apr. 3, 2018, pp. 1-5.

*Primary Examiner* — Jennifer Bahls
(74) *Attorney, Agent, or Firm* — McDonnell Boehnen Hulbert & Berghoff LLP

(57) ABSTRACT

A stamp device includes a main body. The main body includes a bottom plate on which a carrier and a stamp are placed, a pressing plate which cooperates with the bottom plate to press the carrier and the stamp, a limiting structure for limiting a lateral relative movement of the pressing plate and the bottom plate, and a connecting structure for folding and unfolding the main body. An upper surface of the bottom plate is provided with a working space for placing the carrier and the stamp. The present invention uses the pressing plate and the bottom plate to press the stamp and the carrier for stamping the pattern on the carrier. A movement space cooperates with a limiting member to limit the lateral movement of the pressing plate.

16 Claims, 12 Drawing Sheets

(51) Int. Cl.
*B41K 3/32* (2006.01)
*B44B 5/00* (2006.01)

(56) References Cited

U.S. PATENT DOCUMENTS

| | | | | |
|---|---|---|---|---|
| 8,393,266 | B2 * | 3/2013 | Rasmussen | B41F 1/02 101/287 |
| 2016/0200126 | A1 | 7/2016 | Myska | |
| 2016/0271380 | A1 * | 9/2016 | Poon | A61M 37/0015 |

FOREIGN PATENT DOCUMENTS

| | | | | |
|---|---|---|---|---|
| CN | 106004131 | | 10/2016 | |
| DE | 202012012034 | U2 * | 8/2013 | B41K 1/00 |
| GB | 2503660 | | 1/2014 | |
| JP | H10119411 | A | 5/1998 | |

* cited by examiner

STAMP DEVICE

FIELD OF THE INVENTION

The present invention relates to a pattern stamp device, and more particularly to a stamp device.

BACKGROUND OF THE INVENTION

A stamp, used as stationery to stamp a seal on the document for identification or signing, is also used in hand-made decorations, cards, other DIY works, etc. A conventional stamp is engraved with a word and pattern on a solid material. In use, the side having the word or pattern of the stamp is firstly pasted with the pigment, and then the word or pattern at the side of the stamp is manually printed on a carrier to obtain a corresponding pattern on the carrier.

However, in this way, because the user's pressing force on the stamp is not uniform, the pattern on the carrier is incomplete and is not uniform. The appearance is poor. In use, after the stamp is first stamped, the stamping effect is often imperfect or incomplete. Therefore, the second or even multiple stamping is to be performed at the same position of the pattern. However, it is difficult to accurately align the stamping, the position of the stamp is slightly offset, and the printed pattern becomes blurred, which cannot meet the needs of people. There is no ready-made tool on the market that allows the stamp to be accurately positioned when it is overprinted.

SUMMARY OF THE INVENTION

The main technical problem to be solved by the present invention is to provide a stamp device. The present invention uses a pressing plate and a bottom plate to press a stamp and a carrier for stamping a pattern on the carrier. A movement space cooperates with a limiting member to limit the lateral movement of the pressing plate. During the pressing process, the pressing plate is moved down horizontally as much as possible. The stamp adhered to the pressing plate maintains the precise positioning relative to the bottom plate, so that the stamp can print the pattern repeatedly at the same position of the carrier. It is adapted for stamps of different thicknesses. The stamp is evenly stressed, so that the printed pattern is complete and uniform and more beautiful. The device is simple in structure, small in size, easy in operation, convenient to carry, low in manufacturing cost, and suitable for any user.

The technical solution adopted by the present invention to solve the above technical problems is described below. A stamp device comprises a main body. The main body comprises a bottom plate on which a carrier and a stamp are placed, a pressing plate which cooperates with the bottom plate to press the carrier and the stamp, a limiting structure for limiting a lateral relative movement of the pressing plate and the bottom plate, and a connecting structure for folding and unfolding the main body. An upper surface of the bottom plate is provided with a working space for placing the carrier and the stamp.

Through the above technical solution, the limiting structure is configured to limit the lateral movement of the pressing plate and the bottom plate. The printed pattern is better. The connecting structure is convenient for the user to fold and unfold the main body, and the operation is easy and convenient. The device is simple in structure, small in size, easy in operation, convenient to carry, low in manufacturing cost, and suitable for any user. The carrier may be paper, cardboard, cloth, metal sheet, EVA, etc. The stamp adhered to the pressing plate is used to print the pattern repeatedly at the same position of the carrier without deviation. The stamp of the device is made of silicone, rubber and other airtight materials. The device can use a stamp with a larger thickness and has good adaptability. Such a stamp does not require a handle, only the front end is engraved with a pattern or word. The pattern or word of the stamp is often complicated and varied.

Furthermore, the limiting structure includes a movement space on the bottom plate and a limiting member that is matched with and limited in the movement space, the movement space limits a lateral movement of the limiting member; the limiting member is disposed on the pressing plate, and the limiting member is longitudinally moved in the movement space along with the pressing plate synchronously.

Through the above technical solution, the arrangement of the movement space and the limiting member limits the lateral movement of the pressing plate, and the limiting member can move longitudinally with the pressing plate in the movement space, so that the pressing plate can maintain horizontal and longitudinal movement as much as possible. The entire stamp is stressed uniformly. The stamp adhered to the pressing plate maintains the precise positioning relative to the bottom plate. It is adapted for stamps of different thicknesses. The printed pattern is more aesthetically pleasing.

Furthermore, the connecting structure comprises the movement space and the limiting member rotating in the movement space.

Through the above technical solution, the connecting structure and the limiting structure are integrated. The structure is simplified, the manufacture is convenient, and the cost is reduced.

Furthermore, the connecting structure is a magnetic attracting structure.

Through the above technical solution, the magnetic attracting structure limits the lateral movement of the pressing plate and the bottom plate, and the printed pattern is better.

In the above, the attracting force of the magnetic attracting structure is distributed along the edge of the bottom plate or near the edge.

In some embodiments, the magnetic attracting structure has an attracting force continuously distributed along the edge of the pressing plate or near the edge, for example, the magnetic attracting structure may adopt a straight strip magnetic member. In some embodiments, the attracting force of the magnetic attracting structure is discontinuously distributed along the edge of the pressing plate or near the edge, for example, the edge of the pressing plate is provided with a plurality of first attracting members, and the bottom plate is provided with a plurality of second attracting members that are matched with the first attracting members.

Furthermore, the magnetic attracting structure includes a first attracting member and a second attracting member that is attracted to or separated from the first attracting member, the first attracting member is disposed on the bottom plate, and the second attracting member is disposed on the pressing plate corresponding in position to the first attracting member.

The main body has an unfolded state and a folded state. When the main body is in the unfolded position, the first attracting member is detached from the second attracting member. When the main body is in the folded state, the first attracting member and the second attracting member are attracted to each other through the attracting force.

Furthermore, the first attracting member is a magnetic member or an object that can be attracted by the magnetic member.

Specifically, when the first attracting member is a magnetic member, the second attracting member is a magnetic member or an object that can be attracted by the magnetic member; when the first attracting member is an object that can be attracted by the magnetic member, the second attracting member is a magnetic member.

Furthermore, the first attracting member and/or the second attracting member are elastically telescopically disposed on the pressing plate or the bottom plate.

Furthermore, the first attracting member and/or the second attracting member are fixedly disposed on the pressing plate or the bottom plate.

Furthermore, the first attracting member and/or the second attracting member are elastically telescopically disposed on the pressing plate or the bottom plate through a push device. The push device includes an immovable housing disposed on the pressing plate or the bottom plate, a movable housing that can be axially moved in the immovable housing, and a first elastic member located between the immovable housing and the movable housing. The movable housing can be axially moved along the immovable housing through the first elastic member.

Furthermore, the movable housing is provided with a first mounting groove for accommodating the first attracting member and a second mounting groove for accommodating the first elastic member.

Furthermore, the main body has an elastic telescopic structure for supporting the pressing plate and the bottom plate when the main body is in a folded state, and the elastic telescopic structure is disposed on the pressing plate or on the bottom plate.

Through the above technical solution, the elastic telescopic structure improves the movement stability of the pressing plate when the user presses the pressing plate downward, so that the pressure on the pressing plate can be controlled, the printed pattern is more beautiful, and the connection stability of the pressing plate and the bottom plate is improved.

After the pressure on the pressing plate is removed, the pressing plate automatically moves up longitudinally under the action of the elastic telescopic structure to avoid damage to the pattern. It is convenient for people to use. The pressing plate and the bottom plate can be automatically returned, so that the stamp and the carrier adhered to the pressing plate are separated from each other to prevent the ink from being erroneously adhered to the carrier. The arrangement of the elastic telescopic structure can improve the feel of the stamping operation. The elastic telescopic structures may be all mounted on the pressing plate or the bottom plate, or both the pressing plate and the bottom plate are provided with the elastic telescopic structures, respectively. The elastic telescopic structure may be a rubber elastic member, a foaming sponge or the like directly bonded to the pressing plate or the bottom plate, and has a simple structure.

Furthermore, the elastic telescopic structure includes a groove and a movable block that is confined in the groove. A top of the movable block can extend out and retract in the groove. An inside of the groove is provided with an elastic member for driving the movable block to be returned. In a natural state, the top of the movable block extends out of the groove.

Through the above technical solution, the cooperative connection of the movable block, the groove and the elastic member has a simple structure and is convenient to manufacture.

Furthermore, an edge of the working space is provided with a longitudinal boss, and a side wall of the longitudinal boss adjacent to the working space is a limiting plane for limiting the carrier.

Through the above technical solution, the longitudinal boss plays a very good limiting role on the carrier, and the carrier is not easy to move in the working space during the stamping process, and the stamping effect is good.

Furthermore, wherein an edge of the working space is provided with a scale mark.

Through the above technical solution, the edge of the working space is provided with the scale mark, which is convenient to determine the position of the pattern on the carrier.

Furthermore, the bottom plate is a magnetic plate or the bottom plate is provided with a magnetic plate.

Furthermore, the stamp device further comprises a magnet in cooperation with the bottom plate.

Through the above technical solution, the magnet and the magnetic plate are attracted to each other. The carrier is placed between the magnet and the upper surface of the bottom plate, so that the carrier can be retained, and the positioning effect is good. When the pattern is printed, the carrier is less likely to slip on the upper surface of the bottom plate.

Furthermore, the magnet is covered with a protective cover having a handle.

Through the above technical solution, the magnet is covered with the protective cover having the handle to prevent the magnet from being damaged. The arrangement of the handle is convenient for moving the magnet.

Furthermore, the movement space is a strip-shaped limiting hole. The limiting member is a limiting rod passing through the strip-shaped limiting hole. Two lateral ends of the limiting rod are in contact with an inner wall of the strip-shaped limiting hole. The limiting rod can move longitudinally in the strip-shaped limiting hole.

Through the above technical solution, the two lateral ends of the limiting rod are in contact with the inner wall of the strip-shaped limiting hole, thereby limiting the lateral movement of the limiting rod and the pressing plate, so that the printed pattern is good. The limiting rod moves longitudinally in the strip-shaped limiting hole, so that the pressing plate is pressed horizontally as much as possible, and the printed pattern is better.

Furthermore, the movement space is a limiting groove, the limiting member is a limiting rod embedded in the limiting groove. Two lateral ends of the limiting rod are in contact with an inner wall of the limiting groove. The limiting rod can move longitudinally in the limiting groove.

Through the above technical solution, the limiting groove facilitates the disassembly and assembly of the pressing plate and the bottom plate, and the limiting rod can rotate in the limiting groove to meet different needs of people.

Furthermore, a distance in the movement space for a longitudinal movement of the limiting member is equal to a maximum distance of a longitudinal movement of the pressing plate.

Through the above technical solution, the maximum distance of the longitudinal movement of the pressing plate refers to the maximum distance that the pressing plate moves downward from the position where the pressing plate is not pressed downward in the folded state when the carrier and the stamp are not placed between the pressing plate and the bottom plate.

Furthermore, the longitudinal boss is L-shaped and has an included angle of 90 degrees.

Through the above technical solution, the longitudinal boss is L-shaped, that is, the boss is arranged at two adjacent sides of the working space. During the stamping process, the carrier is positioned in two orientations of the working space to prevent the carrier from slipping. The positioning effect is good, and the stamped pattern is clear and beautiful. The other two sides of the working space are not provided with the boss. When the stamping is not performed, the movement of the carrier is more convenient, and the carrier is conveniently taken and placed. There are fewer restrictions on the size of the carrier, which can meet the needs of different carriers.

Furthermore, the longitudinal boss is provided with scale marks that are perpendicular to each other.

Through the above technical solution, the longitudinal boss is provided with the scale marks that are perpendicular to each other, which is convenient for users to determine the position of the pattern. The carrier does not cover the scale marks, which is more convenient to use.

Furthermore, the longitudinal boss is elongated. The longitudinal boss and the edge of the working space are provided with scale marks, respectively. The two scale marks are perpendicular to each other.

Through the above technical solution, the longitudinal boss is arranged in a long strip shape, which increases the range of the working space, and the movement of the carrier is more convenient. Both the longitudinal boss and the working space are provided with the scale marks, thereby determining the position of the pattern on the carrier conveniently. It is more convenient for use.

In the above, the longitudinal boss may be a linear boss. One scale mark is on the straight boss, and the other scale mark is on the bottom plate.

In summary, the beneficial effects of the present invention are described below.

(1) The arrangement of the movement space and the limiting member limits the lateral movement of the pressing plate, so that the pressing plate is kept horizontally and pressed as much as possible. The stamp is evenly stressed, so the printed pattern is more beautiful. The structure of the device structure is simple and small. It is easy to carry and can be used by any person at any place. It can be folded and unfolded quickly. It is easy to operate and convenient for people to use. The stamp adhered to the platen can accurately print the pattern many times at the same position of the carrier to obtain an optimum pattern.

(2) The arrangement of the longitudinal boss is convenient for positioning the carrier. The arrangement of the scale mark is convenient for people to determine the position of the pattern. The scale mark is disposed on the longitudinal boss, which is not easily blocked by the carrier. The longitudinal boss is L-shaped. The carrier is limited in two directions, so the positioning effect is good.

(3) The arrangement of the elastic telescopic structure improves the movement stability of the pressing plate when the user presses the pressing plate and facilitates the control of the pressure on the pressing plate. The printed pattern is more beautiful. The connection stability between the pressing plate and the bottom plate can be improved. After the pressure on the pressing plate is removed, the pressing plate automatically moves up longitudinally under the action of the elastic telescopic structure to avoid damage to the pattern. It is convenient for people to use.

(4) The arrangement of the magnetic attracting structure limits the lateral movement of the pressing plate. The pressing plate and the elastic telescopic structure can be moved horizontally downward during the pressing process. The stamp adhered to the pressing plate maintains the precise positioning relative to the bottom plate, so that the stamp can print the pattern repeatedly at the same position of the carrier. It can be adapted for stamps of different thicknesses. The stamp is evenly stressed, so that the printed pattern is complete and uniform and more beautiful. The device is simple in structure, small in size, easy in operation, convenient to carry, low in manufacturing cost, and suitable for any user.

(5) The push device is set at the same level as both sides of the elastic telescopic structure, so that it moves horizontally downward during the pressing process. The stamp adhered to the pressing plate maintains the precise positioning relative to the bottom plate, so that the stamp can print the pattern repeatedly at the same position of the carrier. It can be adapted for stamps of different thicknesses. The stamp is evenly stressed, so that the printed pattern is complete and uniform.

Description of reference numbers of the accompanying drawings: 1、main body; 2、bottom plate; 21、working space; 3、pressing plate; 4、limiting structure; 41、first limiting portion; 411、strip-shaped limiting hole; 412、U-shaped groove; 4121、mounting opening; 42、second limiting portion; 421、shaft hole; 43、limiting rod; 5、longitudinal boss; 6、scale mark; 7、elastic telescopic structure; 71、groove; 711、limiting boss; 712、positioning block; 72、movable block; 721、engaging block; 722、mounting groove; 73、spring; 8、protective cover; 81、handle; 82、anti-slip rib; 9、anti-slip surface; 10、magnetic plate; 11、magnetic attracting structure; 1101、first attracting member; 1102、second attracting member; 12、push device; 1201、immovable housing; 1202、movable housing; 1203、first elastic member; 1204、slide groove; 1205、slider; 1206、first mounting groove; 1207、second mounting groove; 13、positioning frame; 14、limiting stop

DETAILED DESCRIPTION OF THE PREFERRED EMBODIMENTS

For a better understanding of the contents of the present invention, further description will be made in conjunction with the specific embodiments and the accompanying drawings. It is to be understood that the examples are only illustrative of the invention and are not intended to limit the scope of the invention. In addition, it should be understood that after reading the contents of the present invention, those skilled in the art may make some non-essential modifications or adjustments to the present invention, which still falls within the protection scope of the present invention.

First Embodiment

Figure 1:
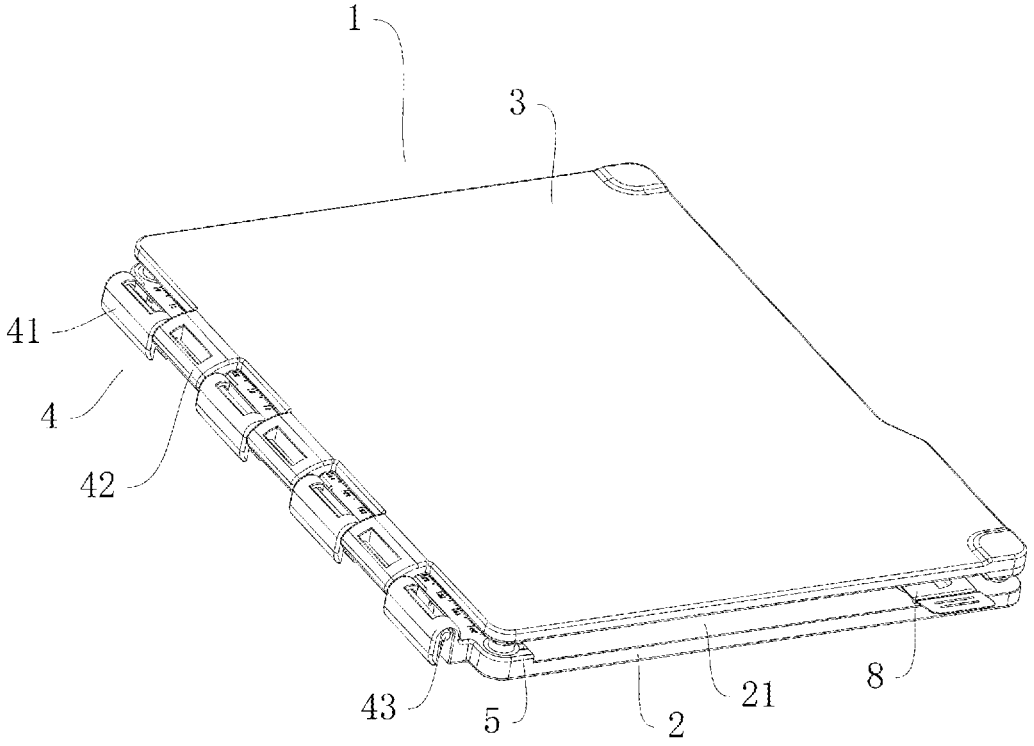
FIG. 1 is a perspective view of the bottom plate and the pressing plate in a closed state in accordance with a first embodiment of the present invention.
Figure 2:
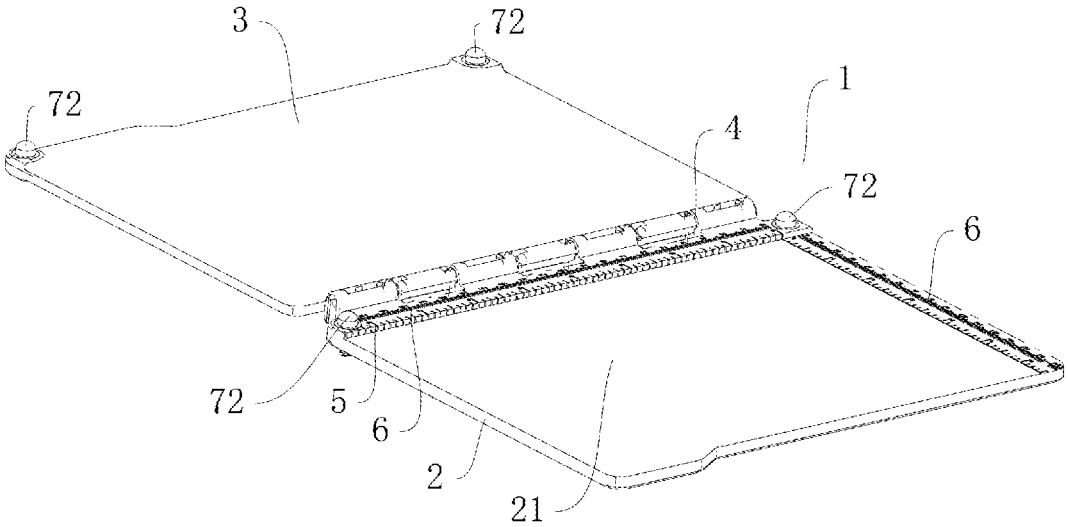
FIG. 2 is a perspective view of the bottom plate and the pressing plate in an open state in accordance with the first embodiment of the present invention.

A stamp device, as shown in FIG. 1 and FIG. 2, comprises a main body 1. The main body 1 comprises a bottom plate 2 on which a carrier and a stamp are placed and a pressing plate 3 which cooperates with the bottom plate 2 to press the carrier and the stamp. The surface of the pressing plate 3 and the upper surface of the bottom plate 2 are flat. The shapes of the bottom plate 2 and the pressing plate 3 are preferably square. The stamp device further comprises a connecting structure for folding and unfolding the pressing plate 3 and the bottom plate 2 and a limiting structure 4 for limiting the lateral relative movement of the pressing plate 3 and the bottom plate 2 when the main body 1 is in a folded state. The upper surface of the bottom plate 2 is provided with a working space 21 for placing the carrier and the stamp. The contours of the working space 21 and the pressing plate 3 are greater than or equal to the contour of the stamp. The carrier may be a card, an ornament, other DIY works, and the like.

The limiting structure 4 includes a movement space on the bottom plate 2 and a limiting member that is matched with and limited in the movement space. The movement space limits the lateral movement of the limiting member. The limiting member is disposed on the pressing plate 3. The limiting member is longitudinally moved in the movement space along with the pressing plate 3 synchronously. The connecting structure comprises the movement space and the limiting member rotating in the movement space. The distance in the movement space for the longitudinal movement of the limiting member is equal to the maximum distance of the longitudinal movement of the pressing plate 3. The maximum distance of the longitudinal movement of the pressing plate 3 refers to the maximum distance that the pressing plate 3 moves downward from the position where the pressing plate 3 is not pressed downward in a folded state when the carrier and the stamp are not placed between the pressing plate 3 and the bottom plate 2.

Figure 4:
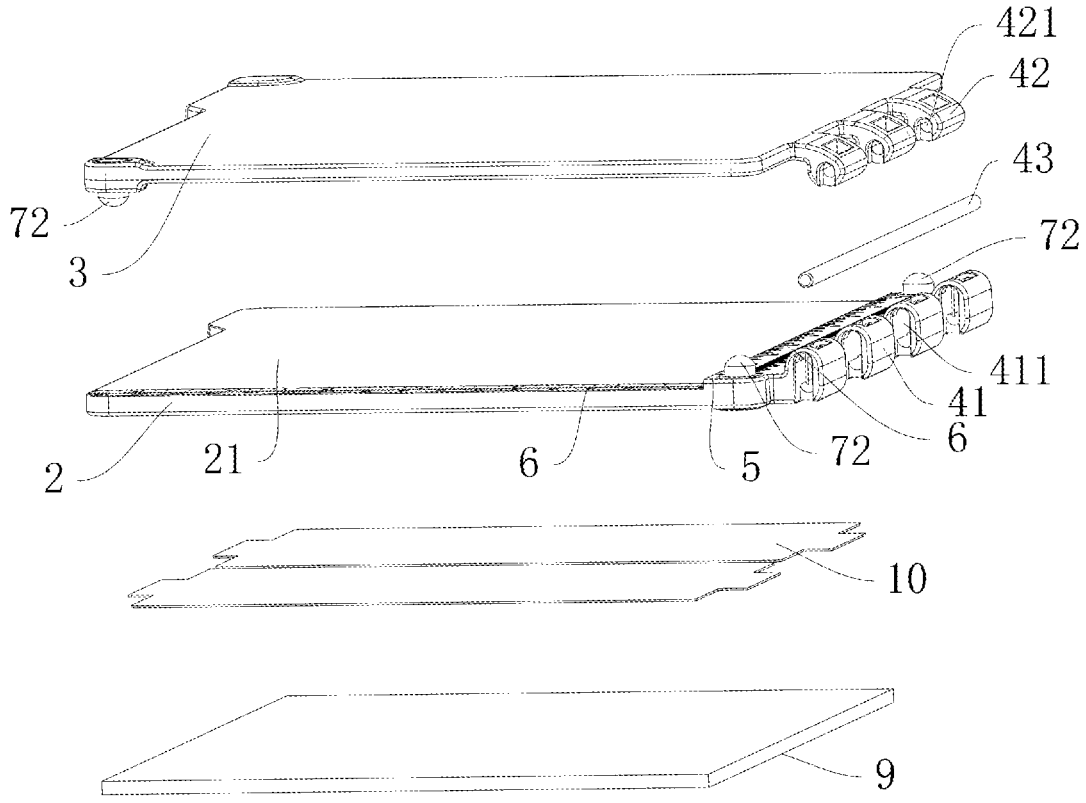
FIG. 4 is an exploded view of the main body in accordance with the first embodiment of the present invention.

Specifically, referring to FIG. 4, the limiting structure 4 includes a first limiting portion 41 disposed on the bottom plate 2 and a second limiting portion 42 disposed on the pressing plate 3 to match the first limiting portion 41. The first limiting portion 41 is provided with the movement space. The second limiting portion 42 includes the limiting member located in the movement space. The first limiting portion 41 extends outwardly from the end of the bottom plate 2 along the surface thereof. This embodiment has first limiting portions 41 that are spaced apart from each other. The movement space is a strip-shaped limiting hole 411 which is defined in each first limiting portion 41 and has a longitudinal strip-shaped cross-section. The opening axes of the strip-shaped limiting holes 411 coincide with each other.

The second limiting portion 42 extends outwardly from the end of the pressing plate 3 along the surface thereof. This embodiment has three second limiting portions 42 that are spaced apart from each other. Each second limiting portion 42 is provided with a shaft hole 421. The axes of the shaft holes 421 coincide with each other. The limiting member is a limiting rod 43 passing through the strip-shaped limiting hole 411 and the shaft hole 421. The limiting rod 43 has a cylindrical shape. The diameter of the limiting rod 43 is equal to the diameter of the shaft hole 421. Two lateral ends of the limiting rod 43 are in contact with the inner wall of the strip-shaped limiting hole 411, so that the limiting rod 43 cannot move laterally in the strip-shaped limiting hole 411. The pressing plate 3 and the limiting rod 43 move synchronously. The pressing plate 3 and the bottom plate 2 are rotatable about the limiting rod 43, that is, the bottom plate 2 and the pressing plate 3 are hingedly connected, so that the pressing plate 3 and the bottom plate 2 can be folded and unfolded. The second limiting portion 42 is engaged between adjacent two of the first limiting portions 41.

In the above, the number of the first limiting portions 41 and the second limiting portions 42 that are spaced apart from each other may be three, five, and so on.

In the above, the limiting rod 43 may have a cylindrical shape such as a prism shape or a strip shape.

The main body 1 has an elastic telescopic structure 7 for supporting the pressing plate 3 and the bottom plate 2 in the folded state. The elastic telescopic structure 7 may be mounted on the pressing plate 3 or mounted on the bottom plate 2. The elastic telescopic structure 7 may be a rubber elastic body, a foaming sponge or the like directly bonded to the pressing plate 3 or the bottom plate 2. The elastic telescopic structure 7 may be mounted on the pressing plate 3, or may be mounted on the bottom plate 2, or may be mounted on both the pressing plate 3 and the bottom plate 2. Preferably, the elastic telescopic structure 7 includes a groove 71 and a movable block 72 that is confined in the groove 71. The top of the movable block 72 can extend out and retract in the groove 71. The inside of the groove 71 is provided with an elastic member for driving the movable block 72 to be returned. Preferably, the elastic member is a spring 73. In a natural state, the top of the movable block 72 extends out of the groove 71.

The inner wall of the groove 71 near the opening is provided with a limiting boss 711. The bottom side wall of the movable block 72 is provided with an engaging block 711 that is in contact with the limiting boss 711, so that the movable block 72 is confined in the groove 71 and won't be disengaged from the groove 71. The bottom of the groove 71 is provided with a positioning block 712. One end of the spring 73 is fitted on the positioning block 712. The bottom of the movable block 72 is provided with a mounting groove 722. The other end of the spring 73 is inserted into the mounting groove 722, thereby improving the working stability of the spring 73.

Furthermore, the limiting boss 711 in the groove 71 is detachably disposed. Specifically, the limiting boss 711 is disposed in the groove 71 by an interference fit, thereby facilitating the disassembly and assembly of the movable block 72.

Furthermore, the telescopic direction of the movable block 72 is perpendicular to the surfaces of the bottom plate 2 and the pressing plate 3. When the main body 1 is in the folded state, the spring 73 is compressed. When the pressing plate 3 is not subjected to an external force, the side wall of the upper portion of the limiting rod 43 is in contact with the inner wall of the strip-shaped limiting hole 411, so that during the movement of the main body 1, the limiting rod 43 is less likely to collide with the strip-shaped limiting hole 411, reducing noise and improving the connection stability between the pressing plate 3 and the bottom plate 2. The use effect is better. When the main body 1 is in the unfolded state, the spring 73 is in a naturally extended position.

The edge of the working space 21 on the bottom plate 2 is provided with a longitudinal boss 5. The side wall of the longitudinal boss 5 adjacent to the working space 21 is a plane for positioning the carrier. The longitudinal boss 5 is located on one side of the bottom plate 2 where the movement space is provided.

Figure 3:
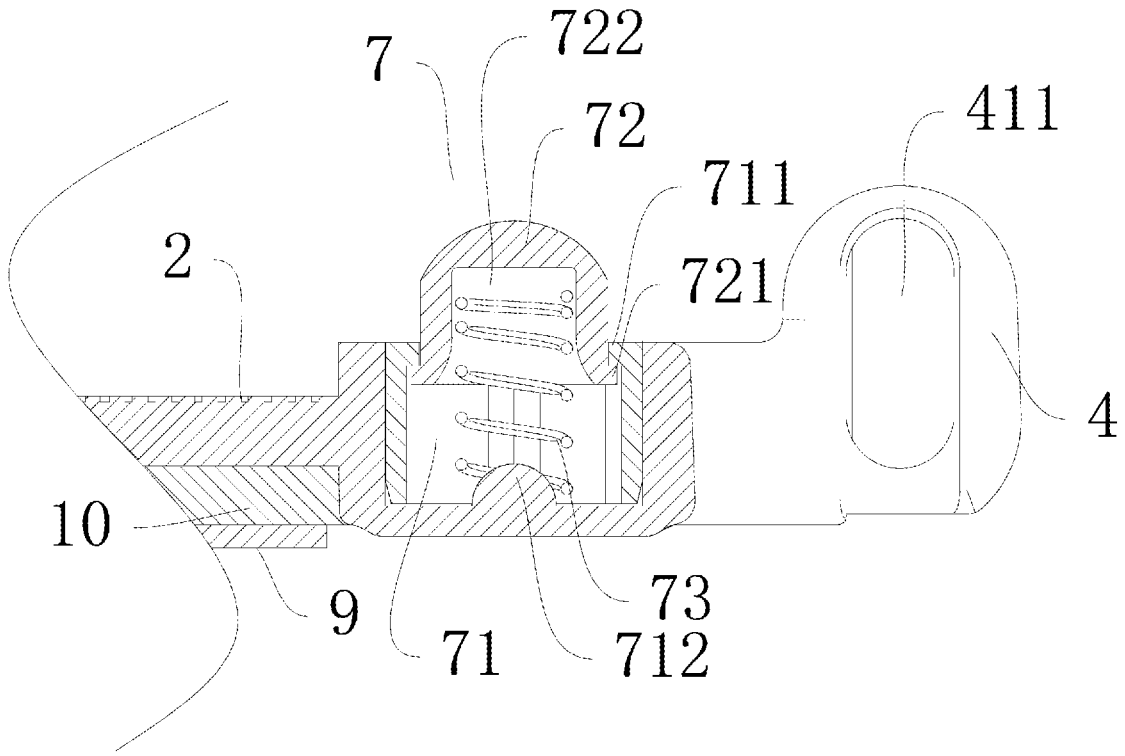
FIG. 3 is a schematic view showing the connection of the elastic telescopic structure and the bottom plate in accordance with the first embodiment of the present invention.

Both the longitudinal boss 5 and the edge of the working space 21 are provided with scale marks 6, respectively. The two scale marks 6 are perpendicular to each other. Specifically, the scale marks 6 are engraved on the longitudinal boss 5 and the bottom plate 2, respectively. Referring to FIG. 3, two elastic telescopic structures 7 are disposed at two ends of the upper surface of the longitudinal boss 5, respectively. In the folded state, the top of the movable block 72 extends out of the groove 71 to abut against the surface of the pressing plate 3. Two elastic telescopic structures 7 are disposed at two corners on the surface of the pressing plate 3, respectively. In the folded state, the top of the movable block 72 extends out of the groove 71 to abut against the surface of the bottom plate 2, and the four movable blocks 72 are located at four corners of the bottom plate 2, respectively. When the pressing plate 3 is not subjected to an external force, the surface of the pressing plate 3 is parallel to the surface of the bottom plate 2.

Figure 5:
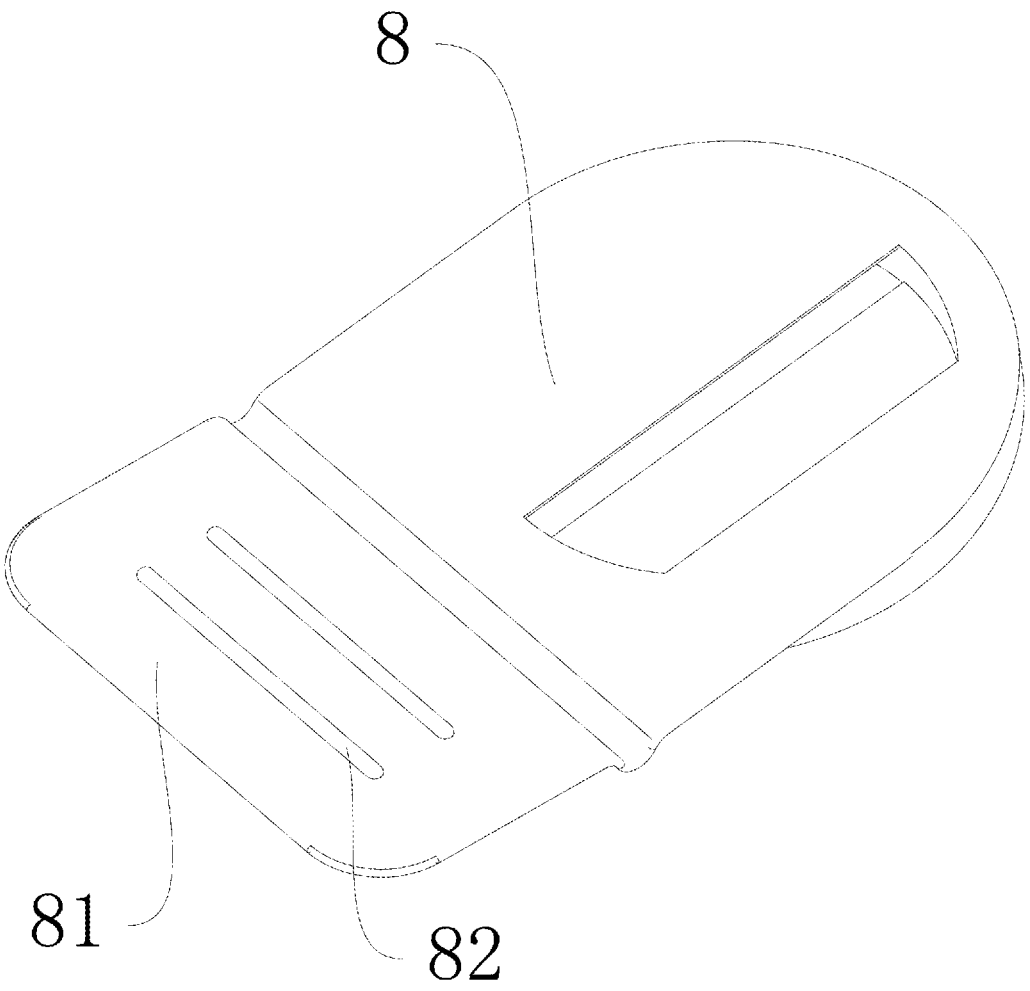
FIG. 5 is a schematic view of the protective cover in accordance with the first embodiment of the present invention.

The bottom surface of the bottom plate 2 is a non-slip surface 9. When the pressing plate 3 is pressed down, the bottom plate 2 is not easy to slide, which is convenient for people to use. The bottom plate 2 is a magnetic plate 10, or the bottom plate 2 is provided with a magnetic plate 10. The stamp device further includes a magnet. The magnet can be attracted on the bottom plate 2 for retaining the carrier. Referring to FIG. 5, the magnet is covered with a protective cover 8 having a handle 81. The handle 81 is provided with a non-slip rib 82 to facilitate the movement of the magnet.

In use, the pressing plate 3 is flipped upward, so the main body 1 is in the unfolded state. The carrier is placed on the working space 21 on the bottom plate 2. The edge of the carrier abuts against the side wall of the longitudinal boss 5. The magnet is placed on the carrier, and the carrier is secured. The stamp is placed on the carrier at an appropriate position with reference to the scale mark 6. The pressing plate 3 is rotated to make the main body 1 to be in the folded state. The movable block 72 on the bottom plate 2 abuts against the surface of the pressing plate 3. The movable block 72 on the pressing plate 3 abuts against the surface of the bottom plate 2. The surface of the pressing plate 3 is parallel to the surface of the bottom plate 2. A certain distance is defined between the pressing plate 3 and the bottom plate 2. When the pressing plate 3 is pressed downward, the pressing plate 3 and the limiting rod 43 are synchronously moved downward in the longitudinal direction. The spring 73 is compressed. The surface of the stamp is completely attached to the surface of the pressing plate 3. The stamp and the carrier are pressed together, and the pattern can be printed on the carrier. Since the stamp is subjected to the force of the pressing plate 3, the pattern printed on the carrier is complete and uniform and the appearance is good. When the downward pressure on the pressing plate 3 is removed, the pressing plate 3 is moved up longitudinally under the returning force of the spring 73.

Second Embodiment

Figure 6:
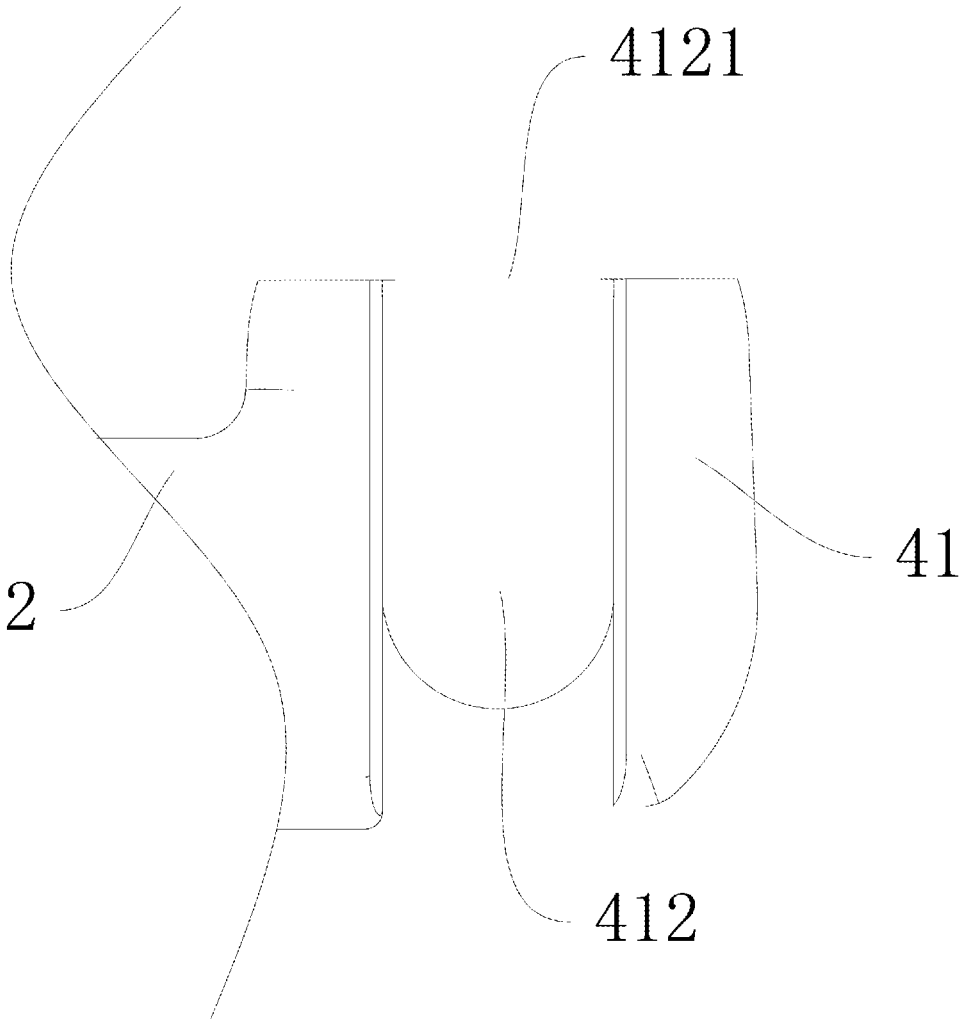
FIG. 6 is a schematic view of the first limiting portion in accordance with a second embodiment of the present invention.

A stamp device comprises a main body 1. The main body 1 comprises a bottom plate 2 on which a carrier and a stamp are placed and a pressing plate 3 which cooperates with the bottom plate 2 to press the carrier and the stamp. The surface of the pressing plate 3 and the upper surface of the bottom plate 2 are flat. Referring to FIG. 6, the second embodiment is substantially similar to the first embodiment with the exceptions described hereinafter. This embodiment has three first limiting portions 41 disposed on the bottom plate 2 and spaced apart from each other. Each first limiting portion 41 is provided with a limiting groove. The limiting groove is provided with a mounting opening 4121 for mounting the limiting rod 43. The limiting groove has a U-shaped cross-section. This embodiment has four second limiting portions 42 that are spaced apart from each other. Each second limiting portion 42 is provided with a shaft hole 421. The axes of the shaft holes 421 coincide with each other. The limiting rod 43 passes through the shaft hole 421. The limiting rod 43 is inserted into the limiting groove from the mounting opening 4121. Each first limiting portion 41 is located between adjacent two of the second limiting portions 42. Two lateral ends of the limiting rod 43 are in contact with the inner wall of the limiting groove, thereby restricting the lateral movement of the limiting rod 43 and the pressing plate 3. The limiting rod 43 can be longitudinally moved in the limiting groove along with the pressing plate 3 synchronously.

Third Embodiment

Figure 7:
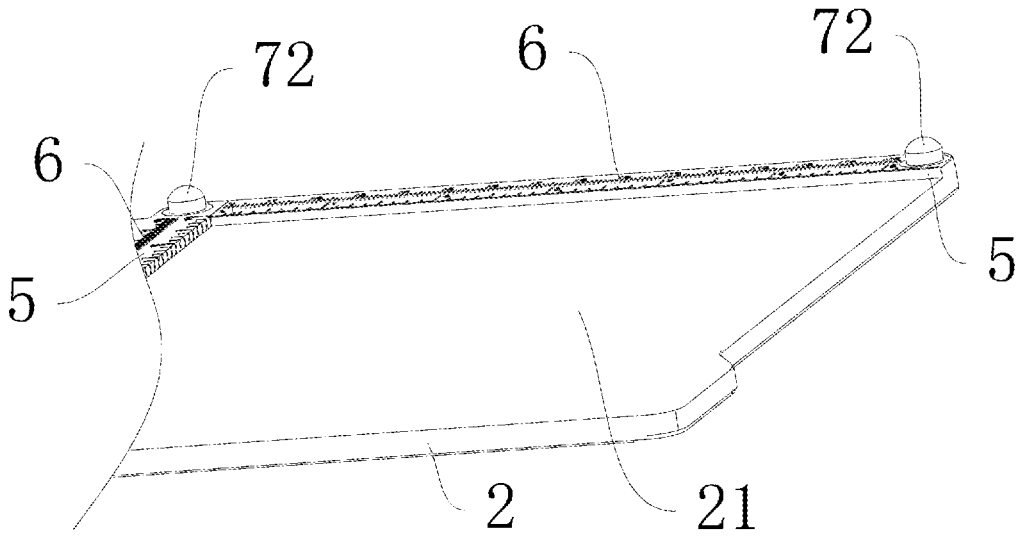
FIG. 7 is a schematic view of the bottom plate in accordance with a third embodiment of the present invention.

A stamp device comprises a main body 1. Referring to FIG. 7, the third embodiment is substantially similar to the first and second embodiments with the exceptions described hereinafter. An L-shaped longitudinal boss 5 is disposed at the edge of the working space 21 on the bottom plate 2. The included angle of the L-shaped longitudinal boss 5 is 90 degrees to improve the positioning effect of the carrier. Two scale marks 6 perpendicular to each other are engraved on the longitudinal boss 5 to facilitate the determination of the position of the pattern on the carrier.

The three end points of the L-shaped longitudinal boss 5 are located at three corners of the bottom plate 2, respectively. Each end point is provided with an elastic telescopic structure 7. The surface of the pressing plate 3 is provided with an elastic telescopic structure 7. In the folded state, the elastic telescopic structure 7 on the pressing plate 3 is located at the corner of the bottom plate 2 where the longitudinal boss 5 is not provided.

Fourth Embodiment

Figure 8:
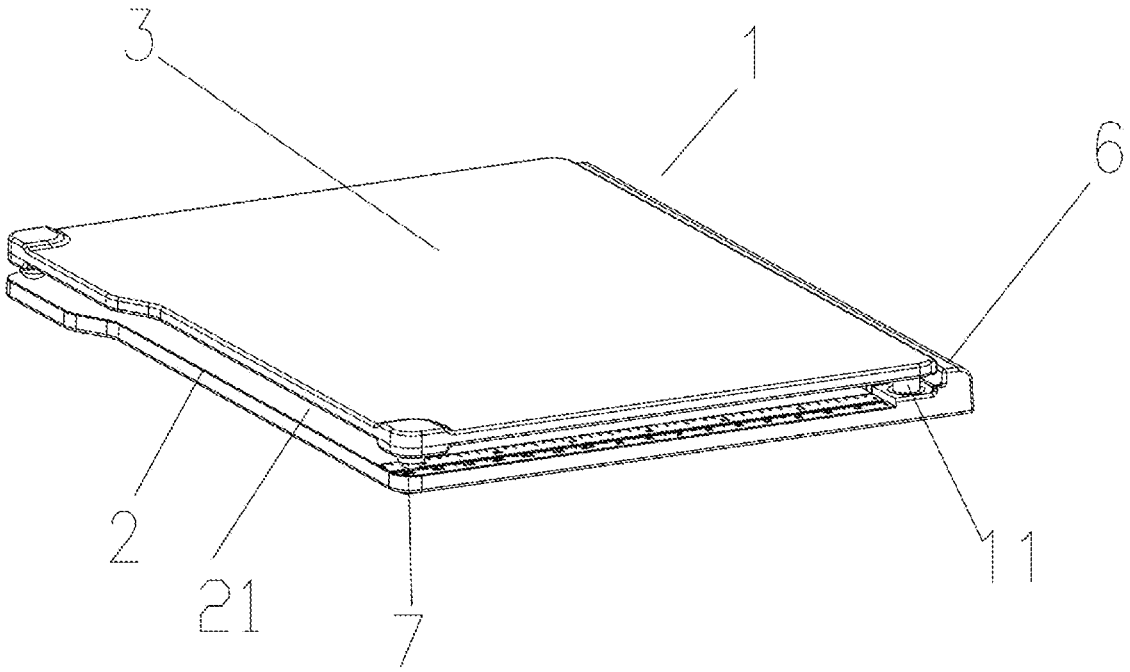
FIG. 8 is a schematic view of the stamp device in accordance with a fourth embodiment of the present invention.
Figure 9:
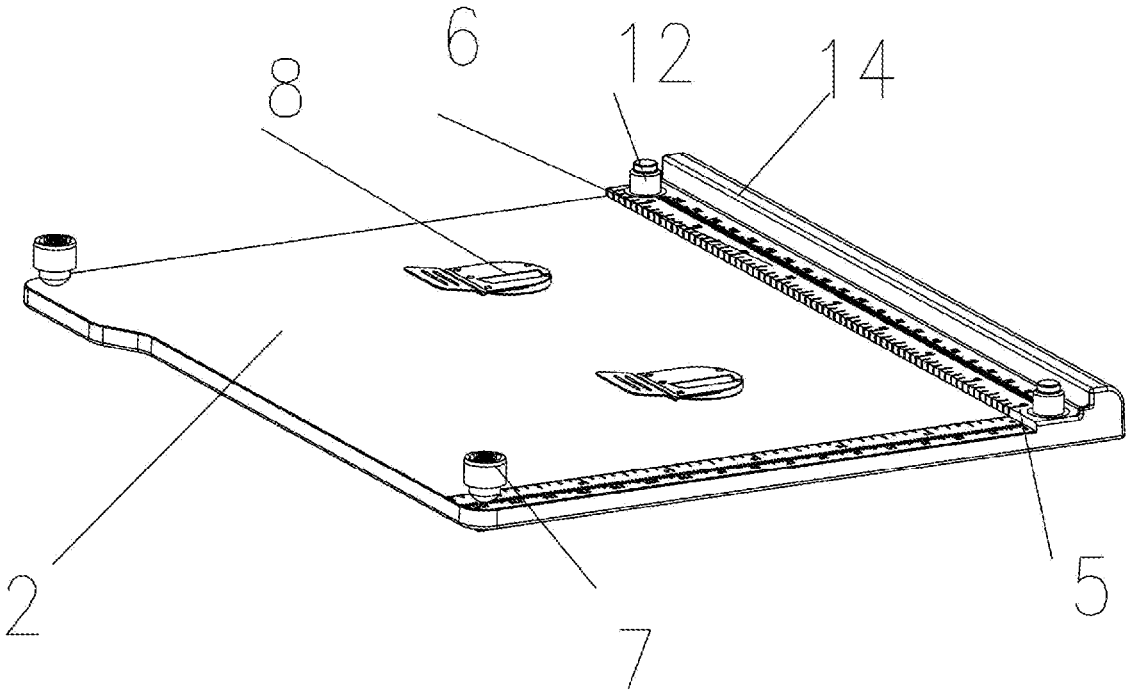
FIG. 9 is a schematic view showing the internal configuration of the stamp device in accordance with the fourth embodiment of the present invention.
Figure 10:
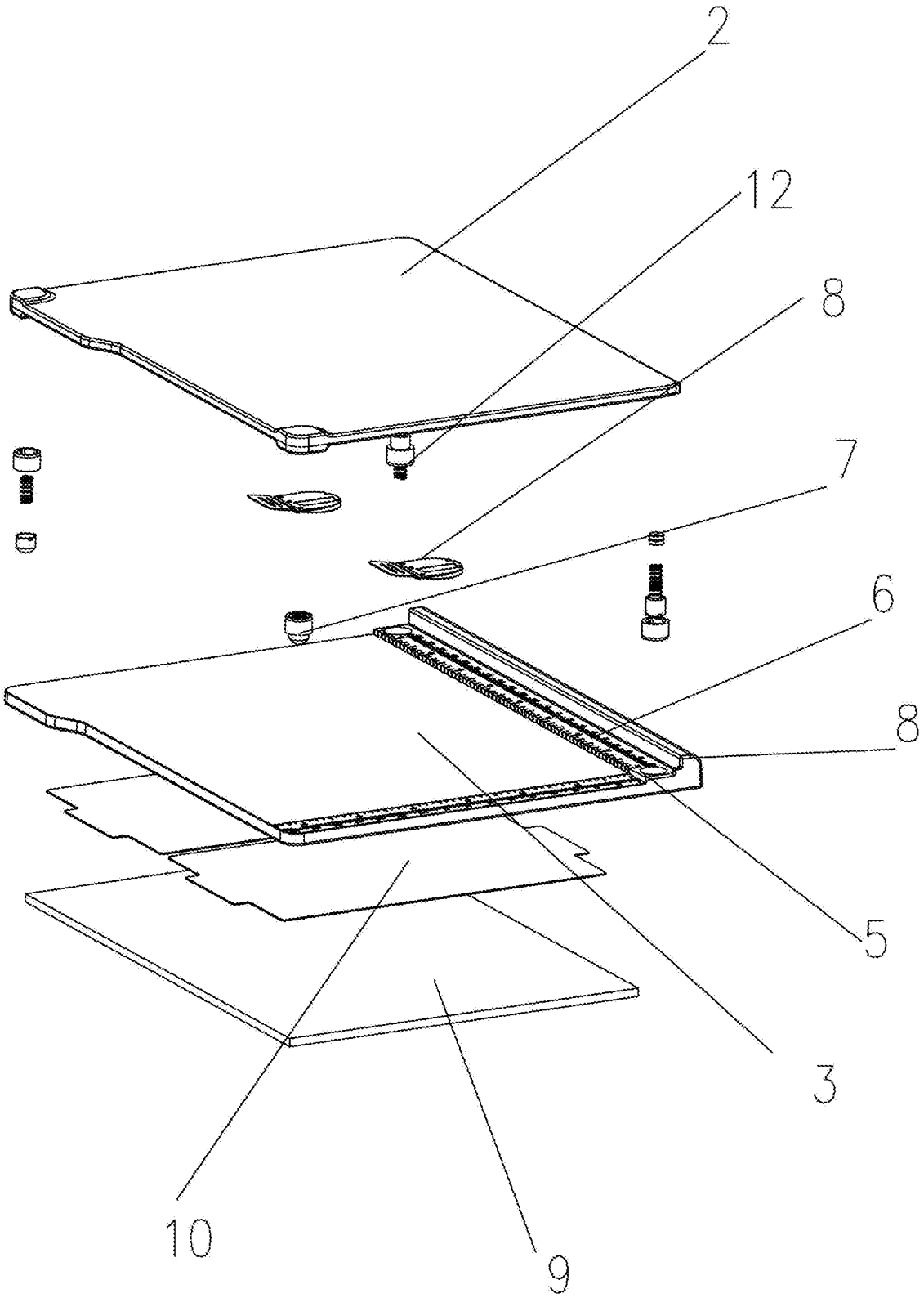
FIG. 10 is an exploded view of the stamp device in accordance with the fourth embodiment of the present invention.

A stamp device comprises a main body 1. Referring to FIG. 8 to FIG. 10, the fourth embodiment is substantially similar to the first, second and third embodiments with the exceptions described hereinafter. The connecting structure is a magnetic attracting structure 11. The magnetic attracting structure 11 includes a first attracting member 1101 and a second attracting member 1102 that is attracted to or separated from the first attracting member 1101. The first attracting member 1101 is disposed on the bottom plate 2. The second attracting member 1102 is disposed on the pressing plate 3 corresponding in position to the first attracting member 1101.

The first attracting member 1101 is a magnetic member or an object that can be attracted by the magnetic member. The first attracting member 1101 and/or the second attracting member 1102 are elastically telescopically disposed on the pressing plate 3 or the bottom plate 2.

Figure 11:
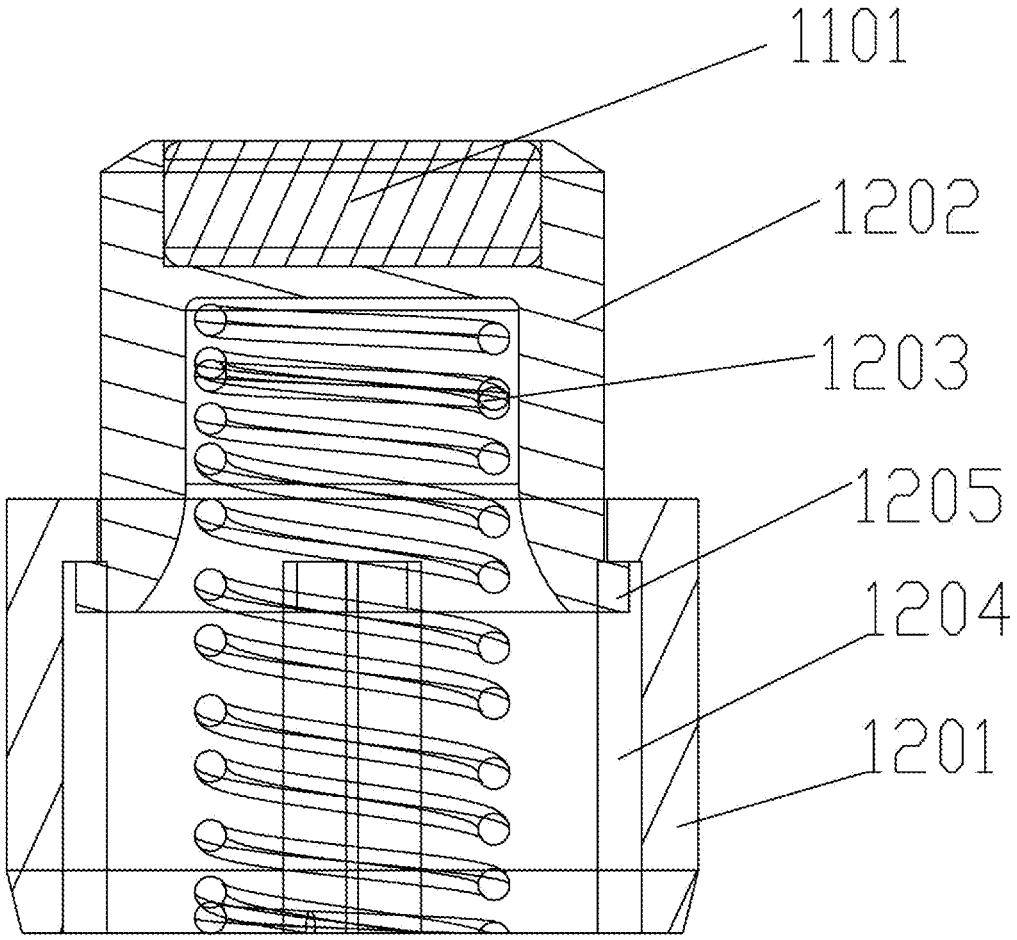
FIG. 11 is a cross-sectional view of the magnetic attracting structure of the stamp device in accordance with the fourth embodiment of the present invention.
Figure 12:
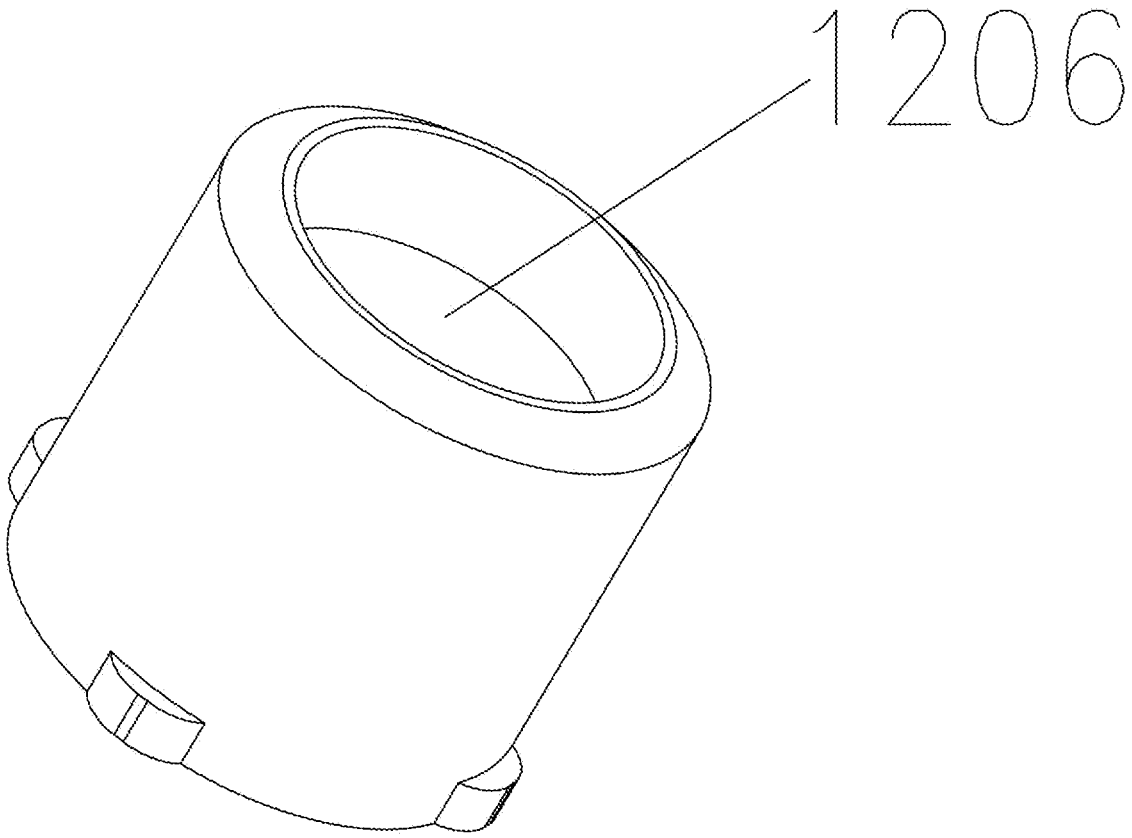
FIG. 12 is a schematic view of the first mounting groove of the stamp device in accordance with the fourth embodiment of the present invention.
Figure 13:
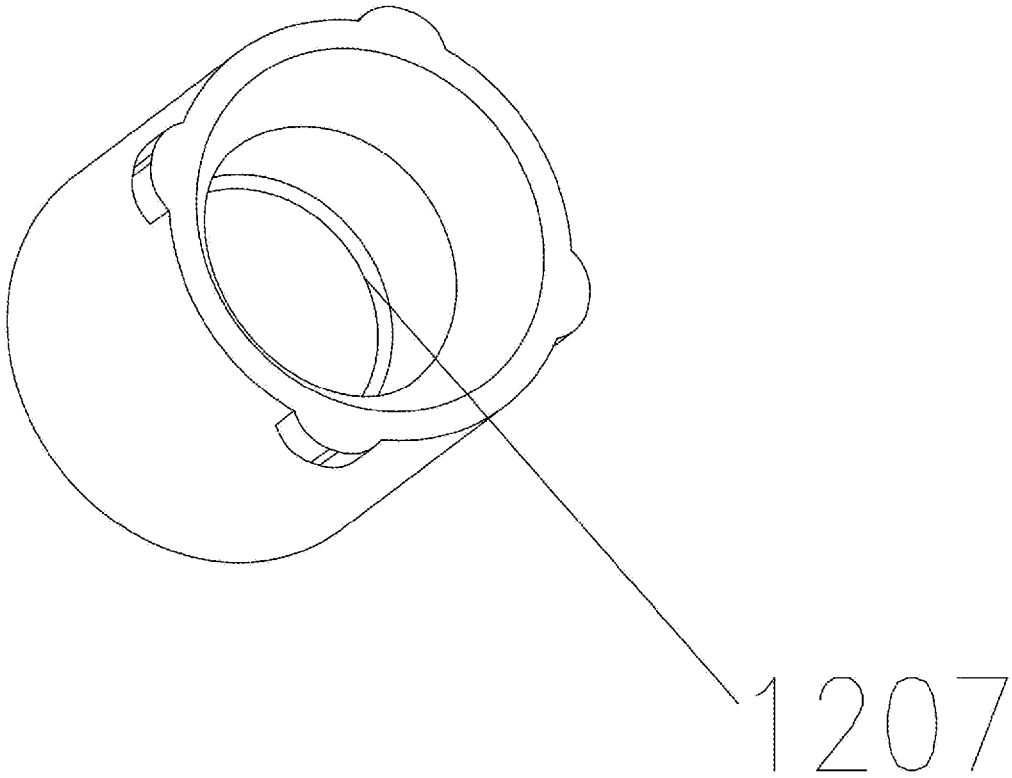
FIG. 13 is a schematic view of the second mounting groove of the stamp device in accordance with the fourth embodiment of the present invention.

As shown in FIG. 11, FIG. 12 and FIG. 13, the first attracting member 1101 and/or the second attracting member 1102 are elastically telescopically disposed on the pressing plate 3 or the bottom plate 2 through a push device 12. The push device 12 includes an immovable housing 1201 disposed on the pressing plate 3 or the bottom plate 2, a movable housing 1202 that can be axially moved in the immovable housing 1201, and a first elastic member 1203 located between the immovable housing 1201 and the movable housing 1202. The movable housing 1202 can be axially moved along the immovable housing 1201 through the first elastic member 1203.

The movable housing 1202 is provided with a first mounting groove 1206 for accommodating the first attracting member 1101 and a second mounting groove 1207 for accommodating the first elastic member 1203.

The movable housing 1202 is axially moved along the immovable housing 1201 through the first elastic member 1203. Preferably, the inner wall of the immovable housing 1201 is formed with a plurality of slide grooves 1204. The outer wall of the movable housing 1202 is provided with sliders 1205 that cooperate with the slide grooves 1204. The movable housing 1202 slides on the immovable housing 1201 through the mutual engagement of the sliders 1205 and the slide grooves 1204.

In use, the pressing plate 3 is flipped upward, so that the pressing plate 3 is placed on the bottom plate 2 in a vertical state through a limiting stop 14 or placed on one side of the bottom plate 2. The carrier is placed in the working space 21 on the bottom plate 2. The edge of the carrier abuts against the side wall of the longitudinal boss 5. The magnetic member is placed on the carrier to retain the carrier. The stamp is placed on the carrier at an appropriate position with reference to the scale mark 6. The pressing plate 3 is turned or the pressing plate 3 covers the bottom plate 2 for the main body 1 to be in the folded state. The movable housing 1202 on the bottom plate 2 abuts against the surface of the pressing plate 3 or the movable block 72 on the pressing plate 3 abuts against the surface of the bottom plate 2, so that the surface of the pressing plate 3 is parallel to the surface of the bottom plate 2. A certain distance is defined between the pressing plate 3 and the bottom plate 2. Then, the pressing plate 3 is pressed down. The first elastic member 1203 and the second elastic member 73 are compressed by the pressing of the pressing plate 3. The surface of the stamp is completely attached to the surface of the pressing plate 3. The stamp and the carrier are pressed together to print the pattern on the carrier. Since the stamp is subjected to the force of the pressing plate 3, the pattern printed on the carrier is complete and uniform, and the appearance is good. When the downward pressure on the pressing plate 3 is removed, the pressing plate 3 is moved up longitudinally under the returning force of the first elastic member 1203 and the second elastic member 73. In some embodiments, the magnetic attracting structure has an attracting force continuously distributed along the edge of the pressing plate or near the edge, for example, the magnetic attracting structure may adopt a straight strip magnetic member. In some embodiments, the attracting force of the magnetic attracting structure is discontinuously distributed along the edge of the pressing plate or near the edge, for example, the edge of the pressing plate is provided with a plurality of first attracting members, and the bottom plate is provided with a plurality of second attracting members that are matched with the first attracting members.

Fifth Embodiment

The fifth embodiment is substantially similar to the fourth embodiment, and the difference is that both the first attracting member 1101 and the second attracting member 1102 are fixedly disposed on the pressing plate 3 or the bottom plate 2. For example, the first attracting member 1101 is fixedly disposed on the bottom plate 2, and the second attracting member 1102 is fixedly disposed on the pressing plate 3.

When the fifth embodiment is used, the pressing plate 3 is flipped upward, so that the pressing plate 3 is placed on the bottom plate 2 in a vertical state through a limiting stop 14 or placed on one side of the bottom plate 2. The carrier is placed in the working space 21 on the bottom plate 2. The edge of the carrier abuts against the side wall of the longitudinal boss 5. The magnetic member is placed on the carrier to retain the carrier. The stamp is placed on the carrier at an appropriate position with reference to the scale mark 6. The pressing plate 3 is turned or the pressing plate 3 covers the bottom plate 2 for the main body 1 to be in the folded state. The movable block 72 on the bottom plate 2 abuts against the surface of the pressing plate 3 or the movable block 72 on the pressing plate 3 abuts against the surface of the bottom plate 2, so that the surface of the pressing plate 3 is parallel to the surface of the bottom plate 2. A certain distance is defined between the pressing plate 3 and the bottom plate 2. The first attracting member 1101 is fixedly disposed on the bottom plate 2, and the second attracting member 1102 is disposed on the pressing plate 3. The bottom plate 2 is matched with and attracted to the pressing plate 3 through the first attracting member 1101 and the second attracting member 1102. Then, the pressing plate 3 is pressed down. The second elastic member 73 is compressed by the pressing of the pressing plate 3. The surface of the stamp is completely attached to the surface of the pressing plate 3. The stamp and the carrier are pressed together to print the pattern on the carrier. Since the stamp is subjected to the force of the pressing plate 3, the pattern printed on the carrier is complete and uniform, and the appearance is good. When the downward pressure on the pressing plate 3 is removed, the pressing plate 3 is moved up longitudinally under the returning force of the first elastic member 1203 and the second elastic member 73.

Sixth Embodiment

Figure 14:
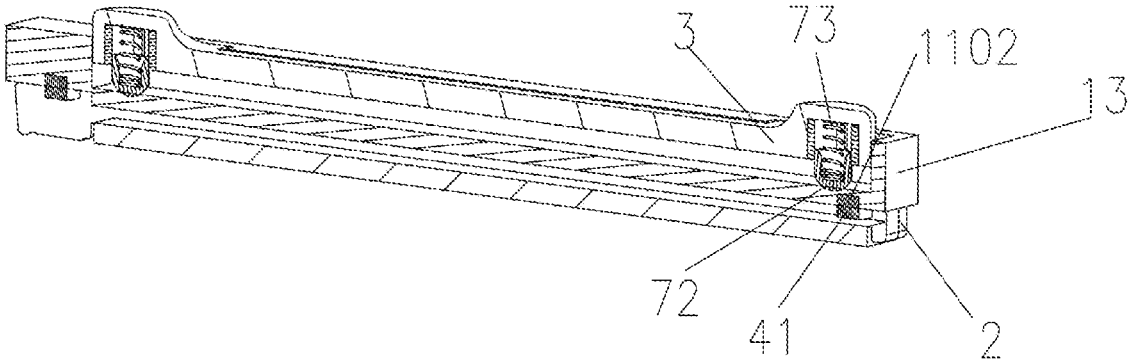
FIG. 14 is a cross-sectional view of the stamp device in accordance with a sixth embodiment of the present invention.

As shown in FIG. 14, in the sixth embodiment, the first attracting member 1101 is fixedly disposed on the bottom plate 2. The pressing plate is movably connected with a positioning frame 13. The positioning frame 13 limits the lateral movement of the pressing plate 3 within the positioning frame 13. The second attracting member 1102 is fixedly disposed on the positioning frame 13. The positioning frame 13 is fixedly coupled to the bottom plate 2 by the mutual cooperation of the second attracting member 1102 and the first attracting member 1101. The side of the pressing plate 3 is provided with the elastic telescopic structure 7 that is embedded in the positioning frame 13.

In use, the carrier is placed in the working space 21 on the bottom plate 2. The edge of the carrier abuts against the side wall of the longitudinal boss 5. The magnetic member is placed on the carrier to retain the carrier. The stamp is placed on the carrier at an appropriate position with reference to the scale mark 6. The positioning frame 13 is fixed and attached to the bottom plate 2 by the cooperation of the second attracting member 1102 and the first attracting member 1101, and then the pressing plate 3 with the elastic telescopic structure 7 is fitted on the positioning frame 13. Then, the pressing plate 3 is pressed down. The second elastic member 73 is compressed by the pressing of the pressing plate 3. The surface of the stamp is completely attached to the surface of the pressing plate 3. The stamp and the carrier are pressed together to print the pattern on the carrier. Since the stamp is subjected to the force of the pressing plate 3, the pattern printed on the carrier is complete and uniform, and the appearance is good. When the downward pressure on the pressing plate 3 is removed, the pressing plate 3 is moved up longitudinally under the returning force of the second elastic member 73.

As described above, the present invention can be preferably implemented.

What is claimed is:

1. A stamp device, comprising a main body, the main body comprising a bottom plate on which a carrier and a stamp are placed, a pressing plate which cooperates with the bottom plate to press the carrier and the stamp, a limiting structure for limiting a lateral relative movement of the pressing plate and the bottom plate, and a connecting structure for folding and unfolding the main body; an upper surface of the bottom plate being provided with a working space for placing the carrier and the stamp;

wherein the main body has an elastic telescopic structure for supporting the pressing plate and the bottom plate when the main body is in a folded state, and the elastic telescopic structure is disposed on the pressing plate or on the bottom plate;

wherein the elastic telescopic structure includes a groove having an opening and a movable block that is confined in the groove, a top of the movable block that can extend out and retract in the groove, an inside of the groove is provided with an elastic member for driving the movable block to be returned, in a natural state, to a position where the top of the movable block extends out of the groove, the elastic member being a spring;

wherein an inner wall of the groove near the opening is provided with a limiting boss; a bottom side wall of the movable block is provided with an engaging block that is in contact with the limiting boss, the movable block is confined in the groove and not disengaged from the groove; and wherein a bottom of the groove is provided with a positioning block; one end of the spring is fitted on the positioning block; a bottom of the movable block is provided with a mounting groove; another end of the spring is inserted into the mounting groove;

wherein the connecting structure is a magnetic attracting structure;

wherein the magnetic attracting structure includes a first attracting member and a second attracting member that is attracted to or separated from the first attracting member; the first attracting member is disposed on the bottom plate, and the second attracting member is disposed on the pressing plate corresponding in position to the first attracting member;

wherein the first attracting member and/or the second attracting member are elastically telescopically disposed on the pressing plate or the bottom plate.

2. The stamp device as claimed in claim 1, wherein the limiting structure includes a movement space on the bottom plate and a limiting member that is matched with and limited in the movement space, the movement space limits a lateral movement of the limiting member; the limiting member is disposed on the pressing plate, and the limiting member is longitudinally moved in the movement space along with the pressing plate synchronously.

3. The stamp device as claimed in claim 2, wherein the connecting structure comprises the movement space and the limiting member rotating in the movement space.

4. The stamp device as claimed in claim 2, wherein the movement space is a strip-shaped limiting hole, the limiting member is a limiting rod passing through the strip-shaped limiting hole, two lateral ends of the limiting rod are in contact with an inner wall of the strip-shaped limiting hole, and the limiting rod can move longitudinally in the strip-shaped limiting hole.

5. The stamp device as claimed in claim 2, wherein the movement space is a limiting groove, the limiting member is a limiting rod embedded in the limiting groove, two lateral ends of the limiting rod are in contact with an inner wall of the limiting groove, and the limiting rod can move longitudinally in the limiting groove.

6. The stamp device as claimed in claim 2, wherein a distance in the movement space for a longitudinal movement of the limiting member is equal to a maximum distance of a longitudinal movement of the pressing plate.

7. The stamp device as claimed in claim 1, wherein the first attracting member and/or the second attracting member are fixedly disposed on the pressing plate or the bottom plate.

8. The stamp device as claimed in claim 1, wherein an edge of the working space is provided with a longitudinal boss, and a side wall of the longitudinal boss adjacent to the working space is a limiting plane for limiting the carrier.

9. The stamp device as claimed in claim 8, wherein the longitudinal boss is L-shaped and has an included angle of 90 degrees; the longitudinal boss is provided with scale marks that are perpendicular to each other.

10. The stamp device as claimed in claim 8, wherein the longitudinal boss is a linear boss; the longitudinal boss and an edge of the working space are provided with scale marks, respectively; and the two scale marks are perpendicular to each other.

11. The stamp device as claimed in claim 1, wherein the bottom plate is a magnetic plate or the bottom plate is provided with a magnetic plate.

12. The stamp device as claimed in claim 11, further comprising a magnet in cooperation with the bottom plate.

13. The stamp device as claimed in claim 12, wherein the magnet is covered with a protective cover having a handle.

14. The stamp device as claimed in claim 1, wherein the limiting boss is detachably disposed in the groove by an interference fit, thereby facilitating the disassembly and assembly of the movable block.

15. A stamp device, comprising a main body, the main body comprising a bottom plate on which a carrier and a stamp are placed, a pressing plate which cooperates with the bottom plate to press the carrier and the stamp, a limiting structure for limiting a lateral relative movement of the pressing plate and the bottom plate, and a connecting structure for folding and unfolding the main body; an upper surface of the bottom plate being provided with a working space for placing the carrier and the stamp;

wherein the main body has an elastic telescopic structure for supporting the pressing plate and the bottom plate when the main body is in a folded state, and the elastic telescopic structure is disposed on the pressing plate or on the bottom plate;

wherein the elastic telescopic structure includes a groove having an opening and a movable block that is confined in the groove, a top of the movable block can extend out and retract in the groove, an inside of the groove is provided with an elastic member for driving the movable block to be returned, in a natural state, to a position where the top of the movable block extends out of the groove, the elastic member being a spring;

wherein an inner wall of the groove near the opening is provided with a limiting boss; a bottom side wall of the movable block is provided with an engaging block that is in contact with the limiting boss, the movable block is confined in the groove and not disengaged from the groove; and wherein a bottom of the groove is provided with a positioning block; one end of the spring is fitted on the positioning block; a bottom of the movable block is provided with a mounting groove; another end of the spring is inserted into the mounting groove;

wherein the connecting structure is a magnetic attracting structure;

wherein the magnetic attracting structure includes a first attracting member and a second attracting member that is attracted to or separated from the first attracting member; the first attracting member is disposed on the bottom plate, and the second attracting member is disposed on the pressing plate corresponding in position to the first attracting member;

wherein the first attracting member is a magnetic member or an object that can be attracted by the magnetic member;

wherein the first attracting member and/or the second attracting member are elastically telescopically disposed on the pressing plate or the bottom plate through a push device; the push device includes an immovable housing disposed on the pressing plate or the bottom plate, a movable housing that can be axially moved in the immovable housing, and a first elastic member located between the immovable housing and the movable housing; the movable housing can be axially moved along the immovable housing through the first elastic member.

16. The stamp device as claimed in claim 15, wherein the movable housing is provided with a first mounting groove for accommodating the first attracting member and a second mounting groove for accommodating the first elastic member.

* * * * *